United States Patent [19]

Jacobs et al.

[11] 4,208,988

[45] Jun. 24, 1980

[54] ANTIVIBRATION SPACER TUBE

[75] Inventors: Martin Jacobs, Hartford; Raul J. Roccatagliata, Vernon, both of Conn.

[73] Assignee: Combustion Engineering, Inc., Windsor, Conn.

[21] Appl. No.: 953,058

[22] Filed: Oct. 19, 1978

[51] Int. Cl.[2] ..... F22B 37/24

[52] U.S. Cl. ..... 122/510; 165/172

[58] Field of Search ..... 122/510; 165/172, 162, 165/82, 173

[56] References Cited

U.S. PATENT DOCUMENTS

| | | | |
|---|---|---|---|
| 1,962,909 | 6/1934 | Price | 122/510 X |
| 2,983,260 | 5/1961 | Huet | 122/510 X |
| 3,232,282 | 2/1966 | Gfrerer | 122/510 |
| 3,265,044 | 8/1966 | Juchtern | 122/510 |

*Primary Examiner*—Edward G. Favors

*Attorney, Agent, or Firm*—Wayne H. Lang

[57] ABSTRACT

Vibration of boiler tubes in a bank of parallel tubes of a multidrum boiler is prevented by means of directing a restraining tube in each bank of tubes obliquely between spaced drums. The oblique tube is welded to the parallel tubes at each point of contact to provide mutual support therefor. Boiling water is directed through the oblique tube as well as the parallel tubes so that circulation through the tubes is enhanced while tube vibration is prevented.

6 Claims, 2 Drawing Figures

ANTIVIBRATION SPACER TUBE

BACKGROUND OF THE INVENTION

Boiler tubes that extend between upper and lower drums of a two drum boiler are subject to varying degrees of tube vibration that may do physical harm to the integrity of the apparatus. This vibration is especially noticeable above about 1500° F. where tube vibration is commonly attributed to impingement with a jet of steam given off by the sootblowers, to vortex shedding, jet switching in combination with less than adequate damping characteristics of the boiler tubes, or it has been attributed to some other flow phenomena that cause flow vortices around the tubes.

The present state of the art is such with gas flow induced vibrations that it is impossible to establish an accurate correlation between gas flow, tube damping, and vibration type failures. Corrective measures have in most cases required the installation of physical restraints that snub the vibration whenever such restraints were deemed necessary.

A standard physical restraint has been developed that is simply connected to the tubes to dampen their vibration, but no change in the basic design of the tube banks has been effected. However, excess vibration occurs only occasionally, so it is not deemed economically expedient to incorporate an expensive vibration restraint into all units before the necessity of such a preventative measure should become evident.

SUMMARY OF THE INVENTION

By this invention an active, inexpensive restraint against vibration is built into each bank of boiler tubes at the time of manufacture. More particularly this invention relates to an arrangement for imparting to a particular tube of a boiler tube bank an oblique bend that is laterally offset from the other tubes of said tube bank to laterally abut the other tubes. The oblique tube may then be welded to the parallel tubes of said tube bank at their points of mutual contact to provide a stable structure that is incapable of vibration. Moreover this arrangement of boiler tubing will simultaneously permit the oblique antivibration tubes as well as the in-line tubes of the boiler to become active in the heat recovery thereof. Furthermore the oblique tubes will enhance fluid contact with the outer surfaces of all tubes to maximize heat transfer between the several fluids.

DESCRIPTION OF A PREFERRED EMBODIMENT

According to the invention a conventional boiler casing is adapted to enclose an upper drum 12 and a lower drum 14 that are connected together by one or more banks of parallel boiler tubes 16. The boiler tubes are connected to the spaced drums in accordance with standard boiler construction whereby the heat of a combusting fuel may be imparted to fluid flowing through the several tubes between drums. Cool boiler water enters the lower drum in accordance with standard practice to define a cool zone, and after passing upward through tubes 16 reaches an upper drum 12 that lies adjacent an outlet or hot zone of the boiler.

Figure 1:
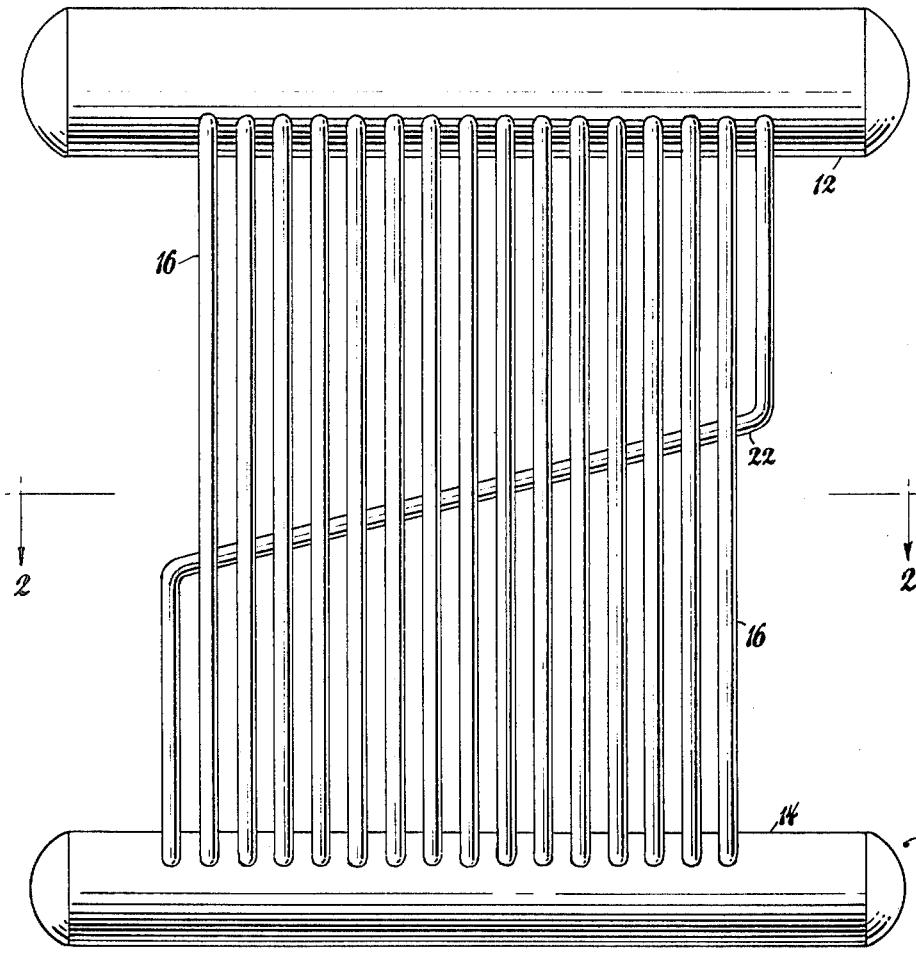
FIG. 1 is a side elevation of a single tube bank simplified to show an oblique tube arranged in accordance with the present invention.
Figure 2:
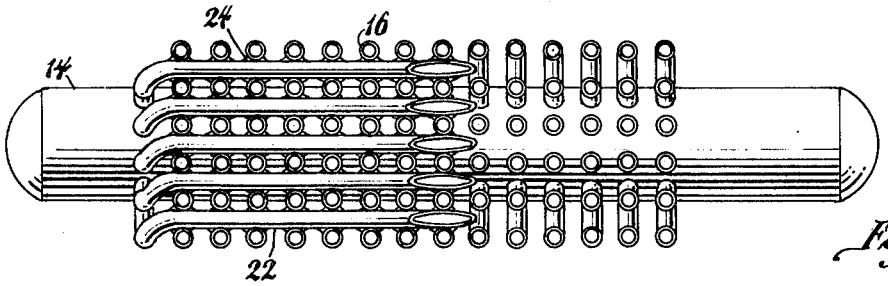
FIG. 2 is a cross-section of the apparatus as seen from line 2—2 of FIG. 1.

Each bank of in-line parallel tubes 16 includes an oblique antivibration or spacer tube 22 that originates in the lower drum 12 and extends upward parallel to the tubes 16 to a point below the midpoint of tubes 16. The tube 22 is then imparted an oblique bend that carries it past the midpoint of tubes 16, where it is again bent to lie parallel with the tubes 16 until it is joined into the upper drum 12. The spacer tube 22 is simultaneously imparted a lateral bend as well as an oblique bend whereby it may laterally abut the intercepted parallel tubes 16 in the manner shown by FIG. 2 of the drawing.

After being connected to both drums 12 and 14 in the manner of all in-line tubes 16, the oblique tube 22 is additionally welded as at 24 to each of the laterally adjacent in-line tubes intercepted thereby. This is particularly true of all tubes lying in a temperature zone that may exceed 1500° F., a temperature zone that is particularly conducive to tube vibration.

Inasmuch as each oblique tube 22 is welded to each of the parallel tubes 16 at their points of lateral contact, a rigid structure that remains free from all vibration is provided. Moreover, since fluid flows through the oblique tubes as well as through the parallel tubes, the capacity of the unit is actually enhanced. Furthermore, the tubes extending obliquely across each tube bank serve as flow deflectors that actually improve the transfer of heat between the fluid flowing over the tubes and the fluid flowing therethrough.

While this invention has been described with respect to an upper and lower drum having a single bank of boiler tubes extending therebetween, it is to be understood that multiple banks or boiler tubes may be arranged in multiple series to extend between drums, and present showing is by way of example only and not by way of limitation.

What is claimed is:

1. A boiler having a lower drum and an upper drum for the containment of a pressurized fluid therein, a bank of parallel tubes extending between the lower drum and upper drum to permit the flow of fluid therebetween, an antivibration tube in said tube bank connected to opposite ends of the upper and lower drums and adapted to extend obliquely therebetween, said obliquely extending tube being offset to lie in laterally abutting relation to the bank of parallel tubes extending between lower and upper drums, and a weldment joining the parallel tubes to the oblique antivibration tube to form an integral assembly.

2. A boiler having a lower drum and an upper drum as defined in claim 1 wherein the oblique tube extends diagonally across the central portion of each bank of parallel tubes.

3. A boiler having a lower drum and an upper drum with tubing extending therebetween in the manner defined by claim 2 wherein the antivibration tube lies in juxtaposition to laterally adjacent banks of parallel tubes.

4. A boiler having a lower drum and an upper drum as defined in claim 3 having a plurality of tube banks in end-to-end relation lying therebetween.

5. A boiler having a lower drum and an upper drum as defined in claim 4 wherein each tube bank between said drums lies adjacent an oblique antivibration tube.

6. A boiler having a lower drum and an upper drum with a plurality of parallel tubes extending therebetween in the manner defined by claim 5 wherein the oblique antivibration tube is welded to the parallel tubes intercepted thereby in a temperature zone that exceeds 1500° F.

* * * * *